US005392620A

United States Patent [19]

Stoltz et al.

[11] Patent Number: 5,392,620

[45] Date of Patent: Feb. 28, 1995

[54] THEFT-DETERRENT DEVICE FOR USE WITH THEFT-ATTRACTIVE ARTICLES

[75] Inventors: Klas Stoltz; Bo Gustavsson, both of Huddinge, Sweden

[73] Assignee: Färgklämman Svenska AB, Huddinge, Sweden

[21] Appl. No.: 120,860

[22] Filed: Aug. 31, 1993

[30] Foreign Application Priority Data

Sep. 1, 1992 [SE] Sweden ..... 9202510

[51] Int. Cl.[6] ..... E05B 65/00; A44B 9/00

[52] U.S. Cl. ..... 70/57.1; 24/704.1

[58] Field of Search ..... 70/57.1; 24/704.1, 706.8; 116/200, 212

[56] References Cited

U.S. PATENT DOCUMENTS

| | | | |
|---|---|---|---|
| 4,221,025 | 9/1980 | Martens et al. | 70/57.1 |
| 4,531,264 | 7/1985 | Minasy | 70/57.1 |
| 4,670,950 | 6/1987 | Wisecup et al. . | |
| 4,944,075 | 7/1990 | Hogan | 70/57.1 |
| 5,022,244 | 6/1991 | Charlot, Jr. | 70/57.1 |
| 5,054,172 | 10/1991 | Hogan et al. | 70/57.1 |
| 5,077,872 | 3/1992 | Guthammar . | |
| 5,088,165 | 2/1992 | Minasy et al. | 70/57.1 |
| 5,205,024 | 4/1993 | Willard | 70/57.1 |

FOREIGN PATENT DOCUMENTS

| | | | |
|---|---|---|---|
| 0482800 | 10/1991 | European Pat. Off. . | |
| 2075116 | 11/1981 | United Kingdom | 70/57.1 |
| 9204705 | 3/1992 | WIPO . | |

*Primary Examiner*—Lloyd A. Gall
*Assistant Examiner*—Darnell M. Boucher
*Attorney, Agent, or Firm*—Browdy and Neimark

[57] ABSTRACT

The present invention relates to a theft deterrent which is intended to be attached to theft-attractive articles and which is constructed for coaction with a release device adapted for the release of the theft deterrent. The theft deterrent includes a first element (10) having a connecting element (12) which projects out from the first element (10) and which is intended to be inserted through an article to be protected, and a second element (14) which can be attached to and locked on the connecting element (12). The second element (14) includes a casing (16) which houses a fragile marking-substance containing ampule (44) and a locking unit (18). The locking unit (18) is intended to receive and lock the elongated connecting element (12) and to be brought into engagement with the ampule when the connecting element is manipulated, so as to fracture the ampule and therewith release the marking-substance contained therein.

20 Claims, 2 Drawing Sheets

THEFT-DETERRENT DEVICE FOR USE WITH THEFT-ATTRACTIVE ARTICLES

The present invention relates to a theft-deterrent intended for attachment to theft-attractive articles and goods and constructed for coaction with a deterrent-release device. The theft deterrent includes a first element having a connecting piece which projects out from the first element and which is intended to be inserted through an article to be protected, and a second element which can be fitted to the connecting piece and locked thereto.

Theft deterrents of this kind are used to prevent the theft of attractive and easily carried goods from retail shops, for instance such goods as clothes, bags, handbags and the like, or to cause people to refrain from stealing such goods. One such known theft deterrent is intended to be attached to an article in a manner such that the deterrent only can be removed from said article with the aid of a special deterrent release device. It is assumed that a potential thief will not have access to this special release device, at least not in the premises where the article is on sale. The purpose of such theft deterrents is to render the article unusable, to all practical purposes, should an attempt be made to remove or to force the deterrent without the aid of the special release device, either by tearing the article or by staining the article with a dye or impregnating the article with an odorous substance or some other appropriate marking-substance contained in a fragile ampule which will fracture when an attempt is made to remove the deterrent.

Since these theft-deterrents are often used on highly valuable capital goods, it is essential that the deterrents can be relied upon. For instance, the deterrent shall be constructed so as to destroy effectively the article to which it is attached should an unauthorized person attempt to release the deterrent from said article in any one of a number of conceivable ways. It is essential that when the ampule containing the marking-substance is broken in such situations, the theft deterrent will disperse the marking-substance effectively to the article and therewith render the article unusable. On the other hand, the construction must prevent the ampule from rupturing when the article or the theft deterrent is handled in a normal way.

A theft deterrent for attachment to theft-attractive goods and comprising two mutually lockable units is known from WO 92/04705. One of these units includes an outwardly projecting, needle-like connecting element and one or more marking-substance containing ampules disposed in a casing. The other unit includes a locking element which is fitted to the connecting element and functions to lock the two units together.

Theft deterrents of this kind are often handled and used in large quantities, meaning that particular requirements are placed on their function and constructional design. In addition to having a reliable function, it is important that the construction or design will enable large numbers of such theft deterrents to be manufactured simply and inexpensively. The theft deterrent will also preferably be light in weight, which is particularly important when the protected article consists in a thin or delicate material which would otherwise be damaged or torn by a heavy theft deterrent.

An object of the present invention is to solve the aforesaid problems by providing a theft deterrent which while having a reliable and secure function will also have a simple construction, so as to enable the deterrent to be produced cheaply, and a low weight.

Accordingly, a theft deterrent of the kind defined in the introduction is characterized in accordance with the invention in that the second element includes a casing in which a fragile marking-substance containing ampule and a locking unit are disposed, wherein the locking unit is intended to receive and lock the elongated connecting element and to be brought into contact with the ampule when the connecting element is manipulated, such as to fracture the ampule and therewith release the marking-substance enclosed therein.

Further advantageous characteristic features of the invention will be evident from the subordinate claims and also from the following description.

A number of advantages are afforded by including both the marking-substance containing ampule and the locking unit in one of the elements. For instance, essentially all of the components are mounted in a single unit and the locking unit can thereby be given the double function of locking the connecting element to the other unit and also of accompanying movement of the connecting element when the deterrent is manipulated incorrectly and thereby ensure that the ampule will be fractured, despite a fewer number of components. The invention also simplifies the process of manufacture, since only one of the units need to be sealed, for instance by ultrasonic welding, and since fewer moulds are required in manufacture and assembly of the deterrent is simpler to achieve. A theft deterrent that is constructed in accordance with the invention also consumes less material, i.e. less plastic material, which reduces costs and also results in a low weight deterrent. Further, the double function of the locking unit means that fewer parts are required, while nevertheless retaining the functional security of the deterrent. All of these advantages contribute towards more effective production and therewith reduced costs for each deterrent produced, and to a finished product of lower weight. The invention will now be described in more detail with reference to an exemplifying embodiment of the invention and also with reference to the accompanying drawings, in which FIG. 1 is a side view of a theft deterrent in accordance with the invention, the article to which the deterrent is attached being indicated solely by a chain line;

Figure 1:
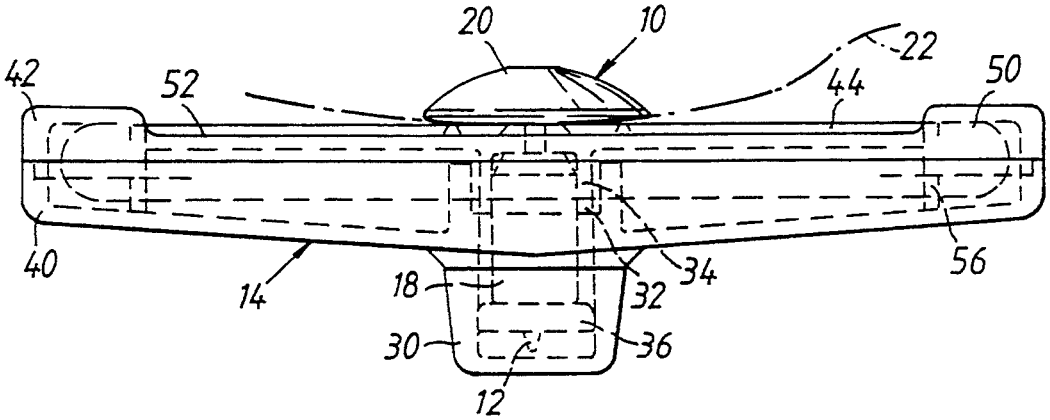

The inventive theft deterrent illustrated in FIG. 1 is shown attached to an article 22, which is shown schematically solely by a chain line. The inventive deterrent comprises two main components, namely a first element 10 which is comprised of a head 20 and a connecting element 12 which projects outwardly from the head 20, and a second element or base element 14 which coacts with the connecting element 12. The head 20 of the first element is comprised of a circular, button-like part which is preferably made of plastic material and in which there is disposed a pointed metal pin 12 which is provided with a circular groove (not shown).

Figure 2:
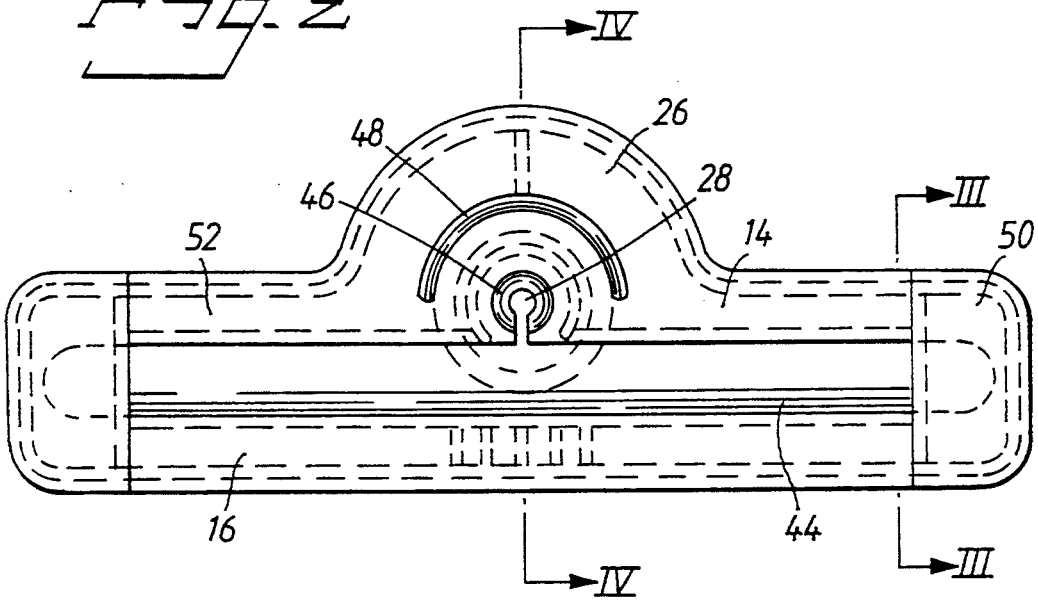
FIG. 2 is a top view of the deterrent shown in FIG. 1, but with the first element removed for the sake of illustration.
Figure 3:
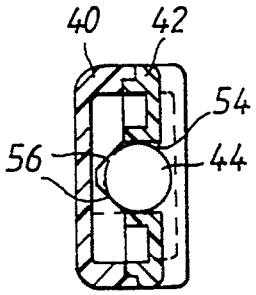
FIG. 3 is a cross-sectional view of the deterrent shown in FIG. 2, taken on the line III—III.

As will best be seen from the top view presented in FIG. 2, the second element has a generally narrow, elongated shape and is provided with a centrally located, semi-circular and outwardly projecting part 26. Provided in the centre of the semi-circular part 26 is a circular hole 28.

The theft deterrent is secured to the article by inserting the pin 12 on the first element 10 through the article at some appropriate position thereon, or by inserting the pin through a small hole pre-formed in the article, for instance through a buttonhole. The pin 12 is then inserted into the hole 28 located centrally on the base element. The two elements 10, 14 are locked together in this position, and thereby also to the article 22 located between said elements, in a manner described in more detail herebelow.

The base element 14 includes internally a metallic locking unit 18 which has a central penetrating hole which is coaxial with the hole 28 in the base element. As will be seen from FIGS. 1 and 4, the locking unit 18 is accommodated partially in an outwardly projecting and downwardly extending cylindrical release part 30. The locking unit 18 is constructed so as to enable the first element 10 carrying the pin 12 to be moved easily axially in one direction in the hole 28, whereas an attempt to move the unit in the other direction and out of the hole 28 will cause the base element 14 to be locked immediately, together with the pin 12.

Figure 4:
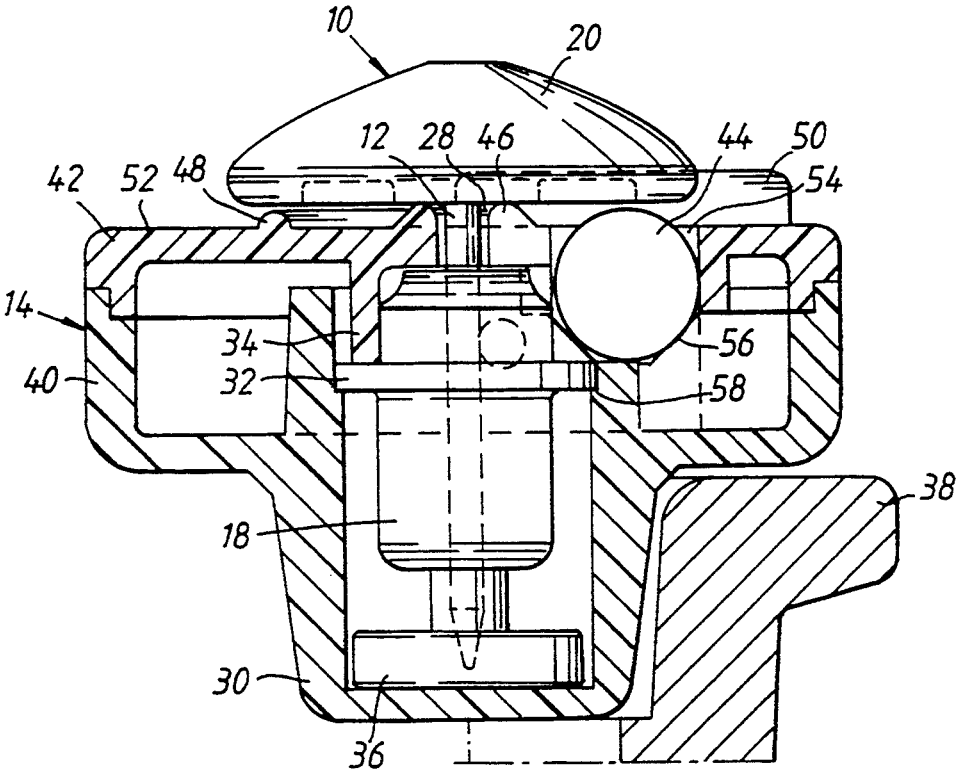
FIG. 4 is a cross-sectional enlarged view of the deterrent shown in FIG. 1 taken on the line IV—IV with the deterrent shown in a released state.

The locking unit 18, which is shown only schematically in FIGS. 1 and 4 and the structural design of which has no bearing on the present invention, includes a number of small metal balls which are disposed in internal grooves in a manner to clamp firmly in the grooves in the pin 12 when the first element 10 is subjected to an outwardly directed force, while allowing the element to be moved inwardly without obstruction. It will be understood that other types of locking devices having a similar function can be used within the scope of the invention.

The locking arrangement can be made inactive, in a known manner, by means of a suitable release device 38 shown schematically in FIG. 4. Thus, the first element 10, and therewith the theft deterrent as a whole, can easily be released with the aid of the release device and removed from said article, for instance when the article has been paid for and a receipt has been given to the purchaser. The intention, of course, is that only authorized persons, for instance cash register personnel, shall have access to the deterrent release device.

The second element, or base element 14, has the form of a plastic casing or housing 16 which, when seen from above as in FIG. 2, has an elongated shape and includes a semicircular central part 26 which projects out centrally from one long side of the element, with the centre of the circle being located on a point between the centre line of the elongated part and the outer long side. The base element 14 comprises a top part 42 and a bottom part 40 which is welded to said top part or permanently joined thereto in some other way. Enclosed between the two parts 40, 42 is a locking unit 18 and a tubular, circular-cylindrical ampule 44 made of glass or some other fragile material, in a manner described in more detail below. The ampule 44 has a given internal overpressure and contains a liquid marking-substance in the form of a dye and/or an odorous substance.

The locking unit 18 is provided externally with a circular locking flange 32, the underside of which rests in a circular recess 58 in the bottom part 40 of the base element 14. The upper side of the locking flange 32 partially abuts a downwardly extending upper flange 34 in the top part 42 of the base element 14. As will be seen from FIG. 2, the upper flange 34 comprises a flange which extends around the locking unit 18 from the ampule side and to the side of the locking unit opposite to said ampule side. The locking unit 18 is thus secured in the base element 14 between the top and the bottom parts so that an axial movable locking plate 36 in the locking unit 18 is able to move in a space beneath the locking unit in the release part 30 in response to activation by the release device 38. Insertion of the release part 30 in the release device 38 activates the locking plate 36 magnetically and therewith releases the metal balls from the pin so as to enable the connecting element 12 to be moved out of the hole 28 and therewith release the two elements 10, 14 from one another.

The top part 42 of the base element 14 has an upstanding shoulder 50 at each short side and a generally flat upper wall 52 which lies between the shoulders and which includes, among other things, an elongated slot 54 whose width corresponds to the diameter of the ampule 44. As will be seen from the Figures, the largest part of the ampule 44 lies in the slot 54 and only the end parts of the ampule extend beyond the ends of the slot and into the shoulders 50.

As best seen from FIGS. 1 and 4, the upper wall 52 is provided with collars 46, 48 which extend around the hole 28 concentrically therewith. As shown in FIG. 2, the inner collar 46 encircles the hole 28 while the outer collar 48 is semi-circular and extends around half the circumference of said hole. When the first element 10 is inserted into the base element 14, the undersurface of the head 20 will lie against the collar 46, with the article placed between the elements. As will be seen from FIG. 4, the highest point of the collar 46 above the upper wall 52 is slightly higher than the highest point of the ampule 44 and the outer collar 48, so as to avoid unintentional fracture of the ampule.

Provided slightly inwards of each short side of the bottom part 40, on the upper side of the bottom wall, is a pair of seats 56 which accommodate respective ends of the ampule 44. These seats are V-shaped when seen in the longitudinal direction of the base element 14, so as to fixate the ampule downwardly and horizontally in its transverse direction. The ampule is thus fixed in its transverse direction within the housing, by being supported adjacent each end at three supportive points which are generally spaced uniformly around the circumference and of which one supportive point is formed by the inner surface of the shoulder 50 and the other two supportive points are formed by the inclined side walls of the seat 56. The ampule is fixed in its longitudinal direction with a given clearance, as for instance will be seen from FIG. 1.

When the head 20, and therewith also the pin 12, are pulled upwards, the locking unit 18 will accompany the upward movement of the pin, so that the locking flange 32 will tend to lift both the flange 34 of the top part and therewith the centre part of the top part 42 and also the centre part of the ampule 44. Because the top part 42 of the base element is made of a plastic material, the inherent elasticity of the material will allow the top part to bend upwards in response to this pulling force, although the ampule 44 is both rigid and fragile and is thus unable to withstand a large force and will therefore fracture.

As will be seen from FIG. 4, that part of the locking flange 32 which is proximal to the ampule 44 is supported solely in the recess or shoulder 58 of the bottom part of the base element and is thus not supported against the flange 34 on said upper part. The locking flange 32 is also dimensioned so that its outer upper edge extends up to the ampule 44, as shown in FIG. 4.

If an attempt is made to force the first element away from the base element, the pulling force and/or the lateral forces exerted on the head 20 will cause the locking unit 18, and therewith the locking flange 32, to move and therewith result in fracture of the ampule, either as a result of being crushed by the pressure exerted by the locking flange 32 and/or by an excessively large bending force.

Consequently, any attempt to pull the element 10 away from the base element 14 while applying on the head, and therewith on the pin, an upwardly directed pulling force and/or lateral forces, which exceed a given limit value will result in the ampule 44 being crushed or fractured, so as to release the marking-substance and therewith render the article unusable in practice. The inventive theft deterrent is constructed so that the aforementioned limit value will be sufficiently large to enable the article and the theft deterrent to be handled in a normal fashion without exceeding said value.

It will be understood that the invention is not restricted to the aforedescribed and illustrated exemplifying embodiment thereof and that several modifications are conceivable within the scope of the following claims. For instance, the theft deterrent can be constructed to house more than one marking-substance containing ampule. Preferably, the ampule has an internal overpressure, but it may instead have an internal atmospheric pressure or any other internal pressure. In another embodiment of the invention the upper wall 52 of the top part 42 is entirely flat without any collars around the hole 28 and the V-shaped seats 56 position the ampule 44 so that the highest point of the ampule is located on the level with or below the upper wall 52. Thus, the undersurface of the head 20 will lie against the flat upper wall 52 with the article placed between the elements. The device may also be supplemented with an alarm system in the form of an alarm element which is activated by a sensor means provided at the exits from the area in which the protected article is kept. According to the invention the term locking unit includes not only the part of the device which has a locking function, but also all associated parts which have movement coaction with said locking unit.

We claim:

1. In a theft deterrent for use with theft-attractive articles or goods, comprising a first element (10) having an elongated connecting element (12) which projects from the first element (10) and which is intended to be inserted through an article to be protected, and a second element (14) which can be attached to said connecting element (12) and locked thereon against movement away from said first element (10) so as to hold the deterrent firmly on said article, the improvement wherein the second element (14) includes a casing (16) which houses a fragile marking-substance containing ampule (44) and a locking unit (18), wherein the locking unit (18) is intended to receive and lock the elongated connecting element (12) and to be brought into contact with the ampule when the connecting element is manipulated such as to cause the ampule to fracture and thus release the marking-substance contained therein.

2. A deterrent according to claim 1, wherein the locking unit (18) is provided with an outer locking flange (32) which is intended to be brought into contact with the side of the ampule (44) opposite to the first element (10) when the connecting element (12) is manipulated.

3. A deterrent according to claim 2, wherein the casing (16) has a generally elongated shape and is comprised of a top part (42) and a bottom part (40) which is joined permanently to said top part (42), wherein the locking flange (32) on the locking unit is clamped firmly between the top and the bottom parts (42, 40) of said casing.

4. A deterrent according to claim 1, wherein the marking-substance containing ampule (44) has a generally tubular shape; in that the ampule is supported at its ends in the casing (16) against movement in a direction towards the first element (10); and in that the locking unit (18) is disposed in the close proximity of the ampule (44) and preferably in the close proximity of the longitudinal centre part of said ampule.

5. A deterrent according to claim 4, wherein the ampule (44) lies along a major part of its length in an open slot (54) provided in the top part (42) of the casing and projects up over the wall surface of said top part (42) towards the first element (10).

6. A deterrent according to claim 5, wherein the width of the slot coincides generally with the diameter of the ampule (44).

7. A deterrent according to claim 1, wherein the second element (14) is provided with a release part (30) which projects out in a direction away from the first element (10); in that a part of the locking unit (18) is enclosed in the release part (30); and in that the release part (30) is intended to be inserted into a release device (38) which is constructed particularly for release of the first element (10) from the second element (12).

8. A deterrent according to claim 7, wherein the locking unit (18) includes an outer locking plate (36) which is movable in the axial direction of the locking unit and which can be moved in the release part (30) by activation of the release device (38) such as to release the connecting element (12) from the second element (14).

9. A deterrent according to claim 1, wherein at least one support surface (46) projecting out towards the first element (10) is arranged centrally on the wall surface of the top part (42) and projects from said wall surface to a further extent than the ampule (44), so that the first element (10) abuts said support surface (46) and the article gripped between the two mutually locked elements (10, 14).

10. A deterrent according to claim 3 wherein the marking-substance containing ampule (44) has a generally tubular shape; the ampule is supported at its ends in the casing (16) against movement in a direction towards the first element (10); and the locking unit (18) is disposed in close proximity of the longitudinal part of said ampule (44).

11. A deterrent according to claim 10 wherein said second element (14) comprises a release part (30) projecting in a direction away from said first element (10); a part of said locking unit (18) is enclosed within said release part (30); and said release part (30) has an exterior shape such that said release part can be inserted into a release device (38) for release of the first element (10) from the second element (14).

12. A deterrent according to claim 11 wherein the locking unit (18) includes an outer locking plate (36) which is movable in the axial direction of the locking unit and which can be moved in the release part (30) by activation of the release device (38) such as to release the connecting member (12) from the second element (14).

13. A deterrent according to claim 12 wherein at least one support surface (46) projecting out towards the first element (10) is arranged centrally on the wall surface of the top part (42) and projects from said wall surface to a further extent than the ampule (44), so that the first element (10) abuts said support surface (46) and the article gripped between the two mutually locked elements (10, 14).

14. In a theft deterrent device for use with theft-attractive articles or goods, comprising a first element (10) having an elongated connecting member (12) which projects from the first element (10) and which in use is inserted through an article to be protected, and a second element (14) which in use is attached to said connecting element (12) and locked thereon against movement away from said first element (10) so as to hold the deterrent device firmly on said article, the improvement wherein the first element (10) consists essentially of said elongated connecting element (12) and a button-like head at one end thereof; and said second element (14) includes an elongated casing (16) housing a fragile marking-substance containing ampule (44) and a release part (30) projecting outwardly in a direction away from the first element (10), said release part (30) defining an internal cavity extending in length in a direction aligned with said elongated connecting element (12); a locking unit (18) disposed at least in part inside the internal cavity defined by said release part (30), said locking unit (18) in use receiving and locking said elongated connecting element (12); said ampule (44) and said locking unit (18) being so disposed relative to one another that when the connecting element (12) is improperly attempted to be pulled from said second element (14), said locking unit (18) is brought into contact with said ampule (44) such as to cause said ampule to fracture and thus release the marking-substance contained therein.

15. A deterrent device according to claim 14 wherein the locking unit (18) is provided with an outer locking flange (32) which is intended to be brought into contact with the side of the ampule (44) opposite to the first element (10) when the connecting element (12) is improperly manipulated.

16. A deterrent according to claim 15 wherein the casing (16) has a generally elongated shape and is comprised of a top part (42) and a bottom part (40) which is joined permanently to said top part (42), wherein the locking flange (32) on the locking unit is clamped firmly between the top and the bottom parts (42, 40) of said casing.

17. A deterrent according to claim 16 wherein the marking-substance containing ampule (44) has a generally tubular shape; the ampule is supported at its ends in the casing (16) against movement in a direction towards the first element (10); and the locking unit (18) is disposed in close proximity of the longitudinal part of said ampule (44).

18. A deterrent according to claim 17 wherein the ampule (44) lies along a major part of its length in an open slot (54) provided in the top part (42) of the casing and projects up over the wall surface of said top part (42) towards the first element (10).

19. A deterrent according to claim 18 wherein the width of the slot coincides generally with the diameter of the ampule (44).

20. A deterrent according to claim 19 wherein at least one support surface (46) projecting out towards the first element (10) is arranged centrally on the wall surface of the top part (42) and projects from said wall surface to a further extent than the ampule (44), so that the first element (10) abuts said support surface (46) and the article gripped between the two mutually locked elements (10, 14).

* * * * *